US009057345B2

(12) United States Patent
Lee et al.

(10) Patent No.: US 9,057,345 B2
(45) Date of Patent: Jun. 16, 2015

(54) CANISTER WITH DUAL AIR FLOW PATHS

(75) Inventors: Dong-Cho Lee, Whasung-Si (KR); Ho-Kyoon Nam, Whasung-Si (KR)

(73) Assignee: HYUNDAI MOTOR COMPANY, Seoul (KR)

( * ) Notice: Subject to any disclaimer, the term of this patent is extended or adjusted under 35 U.S.C. 154(b) by 798 days.

(21) Appl. No.: 13/281,895

(22) Filed: Oct. 26, 2011

(65) Prior Publication Data

US 2012/0138023 A1 Jun. 7, 2012

(30) Foreign Application Priority Data

Dec. 6, 2010 (KR) ..... 10-2010-0123300

(51) Int. Cl.
*F02M 33/02* (2006.01)
*F02M 25/08* (2006.01)

(52) U.S. Cl.
CPC ..... *F02M 25/0854* (2013.01); *F02M 25/0836* (2013.01)

(58) Field of Classification Search
CPC ..... F02M 25/0854; B01D 2259/4516; B01D 2253/102; B01D 53/0407
USPC ..... 96/108, 132, 134, 333; 123/516, 518, 123/519, 520, 521
See application file for complete search history.

(56) References Cited

U.S. PATENT DOCUMENTS

| | | | | |
|---|---|---|---|---|
| 5,398,660 | A * | 3/1995 | Koyama et al. | 123/519 |
| 6,537,354 | B2 * | 3/2003 | Meiller et al. | 96/139 |
| 6,959,698 | B2 * | 11/2005 | Ikuma et al. | 123/519 |
| 7,047,952 | B1 * | 5/2006 | Yamauchi et al. | 123/519 |
| 2004/0173190 | A1 * | 9/2004 | Makino | 123/520 |
| 2005/0022796 | A1 * | 2/2005 | Zuchara | 123/519 |

FOREIGN PATENT DOCUMENTS

| | | | |
|---|---|---|---|
| JP | 2000-64915 | A | 3/2000 |
| JP | 2008-240683 | A | 10/2008 |
| JP | 2009-203838 | A | 9/2009 |
| JP | 2009-250059 | A | 10/2009 |
| KR | 10-0288222 | B1 | 2/2001 |
| KR | 10-0528195 | B1 | 11/2005 |
| KR | 10-0648080 | B1 | 12/2006 |
| KR | 10-0683368 | B1 | 2/2007 |

* cited by examiner

*Primary Examiner* — Mahmoud Gimie
*Assistant Examiner* — Sizo Vilakazi
(74) *Attorney, Agent, or Firm* — Morgan, Lewis & Bockius LLP

(57) ABSTRACT

A canister for a vehicle, and more particularly, a canister with dual air flow paths is configured to divide an inner space of an air entrance of the canister into two spaces and allow air to flow in from an outdoor atmosphere through one space between two spaces in a purging operation and discharge fuel evaporation gas to the outdoor atmosphere through the other space when the fuel evaporation gas is discharged in order to prevent pressure in a fuel tank from being raise raised.

4 Claims, 6 Drawing Sheets

CANISTER WITH DUAL AIR FLOW PATHS

CROSS-REFERENCE TO RELATED APPLICATIONS

This application claims priority under 35 U.S.C. §119 to Korean Patent Application No. 10-2010-123300, filed on Dec. 6, 2010, the entire contents of which application is incorporated herein for all purposes by this reference.

BACKGROUND OF INVENTION

1. Field of Invention

The present invention relates to a canister used in a vehicle, and more particularly, to a canister with dual air flow paths configured to divide an inner space of an air entrance of the canister into two spaces and allow air to flow in from an outdoor atmosphere through one space between two spaces in a purging operation and discharge fuel evaporation gas to the outdoor atmosphere through the other space when the fuel evaporation gas is discharged in order to prevent pressure in a fuel tank from being raised.

2. Description of Related Art

A fuel system apparatus of a vehicle as an apparatus that stores and supplies fuel consumed in an engine includes a fuel tank storing fuel, a fuel pump supplying the fuel in the fuel tank to a vaporizer, a fuel filter removing impurities of the fuel, and a canister collecting and storing evaporated gas of fuel vaporized in the fuel tank.

The canister absorbs the fuel evaporated gas with activated carbon embedded therein if the engine is stopped and desorbs the fuel evaporated gas absorbed in the activated carbon by using intake pressure of air injected from the outside of the canister when the engine is actuated, and then mixes the desorbed fuel evaporated gas with air and supplies the mixed gas to an intake system of the engine. In addition, the operation of supplying the fuel evaporated gas to the engine is generally as a purge operation.

FIG. 1 shows a configuration a general canister. The canister has a housing 1 configuring an appearance thereof and activated carbon 6 for absorbing and desorbing the fuel evaporated gas is charged in the housing 1.

In addition, an air entrance 2 that allows air to flow into the canister from an outdoor atmosphere when the canister performs the purge operation is formed in an upper part of the housing 1.

The air entrance 2 may discharge the fuel evaporated gas in the fuel tank to the outdoor atmosphere in order to prevent the internal pressure of the fuel tank from being raised.

An evaporated gas outlet 3 discharging the fuel evaporated gas absorbed in the activated carbon 6 to the intake system of the engine when the canister performs the purge operation is formed in the upper part of the housing 1.

An evaporated gas inlet 4 flowing in the fuel evaporated gas generated from the fuel tank when the engine is stopped is formed in the upper part of the housing 1.

Filters 5 are mounted on the air entrance 2, the evaporated gas outlet 3, and the evaporated gas inlet 4. The filters 5 serve to interrupt impurities such as dust contained in the air or fuel evaporated gas that is in and out.

However, while air from the outside is supplied to the air entrance 2 when the canister performs the purge operation, impurities such as dust are attached to the surface of the filter 5 installed in an opening at the side of the air entrance 2.

The sizes of pores of the filter 5 are routinely 10 μm. The reason therefor is that the sizes of the pores of the filter 5 are adjusted to be smaller than those of the minute powders of the activated carbon in order to prevent minute powders of the activated carbon from being discharged together while discharging the fuel evaporated gas in the fuel tank to an atmosphere.

Therefore, while impurities in the air having sizes similar to the sizes of the pores cannot pass through the filters 5 in the purge operation, most of the impurities are attached to the surface of the filter 5.

In this case, as shown in a detailed diagram of part A of FIG. 2, an impurity layer D is formed while the impurities attached to the filters 5 are fixed as a use time of the canister is lengthened.

In addition, since the impurity layer D formed on the surface of the filter 5 disturbs smooth flowing of air, outdoor air is not sufficiently supplied when the canister performs the purge operation, and as a result, the fuel tank may deformed or cracked while negative pressure is formed in the fuel tank.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Various aspects of the present invention provide for a configuration of a canister having an air entrance structure in which air can smoothly flow when a canister performs a purge operation.

Various aspects of the present invention provide for a canister with dual air flow paths configured to divide an inner space of an air entrance of the canister into two spaces and allow air to flow in from an outdoor atmosphere through one space between two spaces in a purging operation and discharge fuel evaporation gas to the outdoor atmosphere through the other space when the fuel evaporation gas is discharged in order to prevent pressure in a fuel tank from being raised.

According to various aspects of the present invention, a canister with dual air flow paths has an advantage in that minute powders of activated carbon is not discharged to the outside when fuel evaporated gas is discharged while outdoor air flowing into the canister from an air entrance smoothly flows in a purge operation to thereby prevent a ventilation resistance by clogging of a filter from being increased at the air entrance of the canister in the related art.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Hereinafter, a configuration and an operation of a canister with dual air flow paths according to various embodiments of the present invention will be described in more detail with reference to the accompanying drawings.

However, the accompanying drawings are provided as examples in order to fully transfer the spirit of the present invention to those skilled in the art. Therefore, the present invention is not limited to the accompanying drawings and may be implemented in various forms.

Further, unless terms are defined, they have meanings understood by those skilled in the art and known functions and configurations which may unnecessarily obscure the scope of the present invention will not be described in the following description and accompanying drawings.

Figure 1:
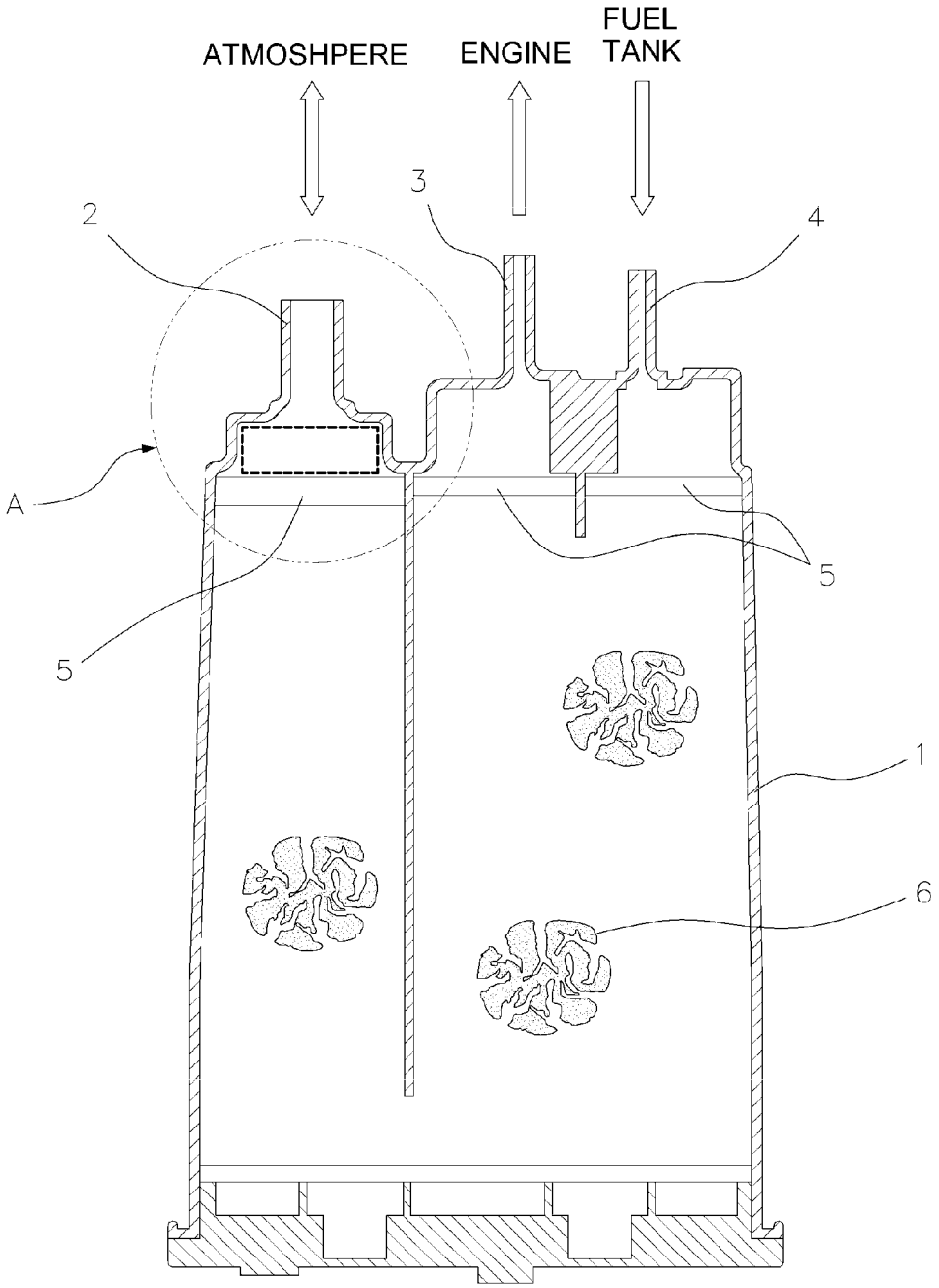
FIG. 1 is a configuration diagram of a general canister.
Figure 2:
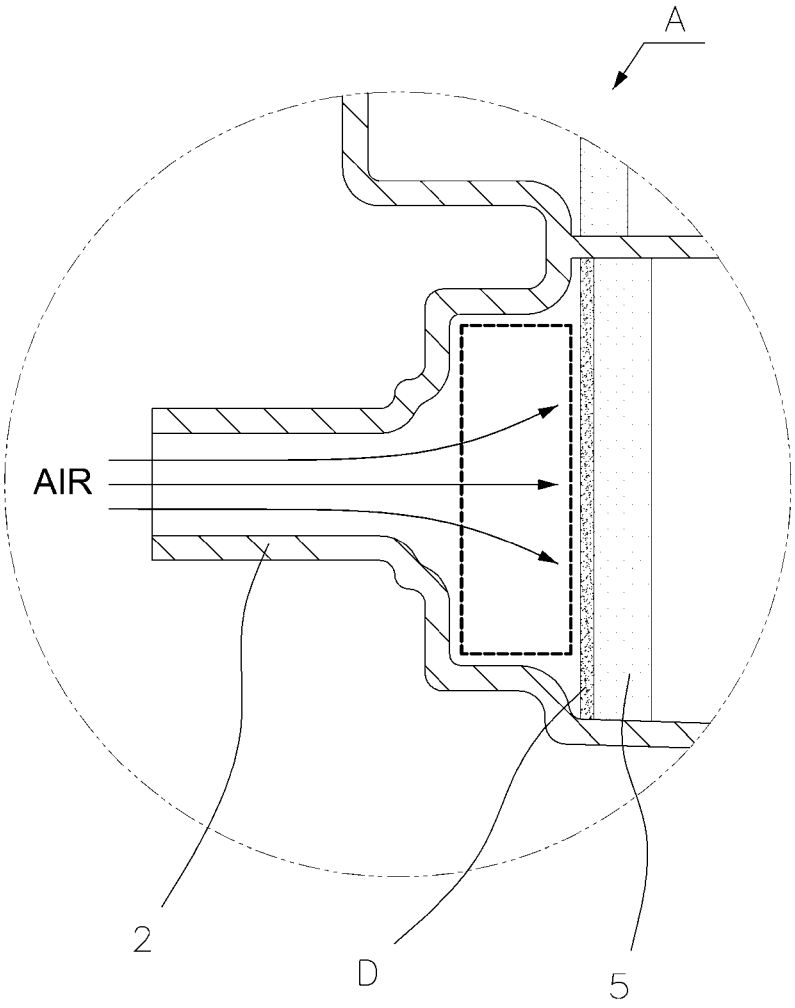
FIG. 2 is a detailed diagram of part A of FIG. 1.
Figure 3:
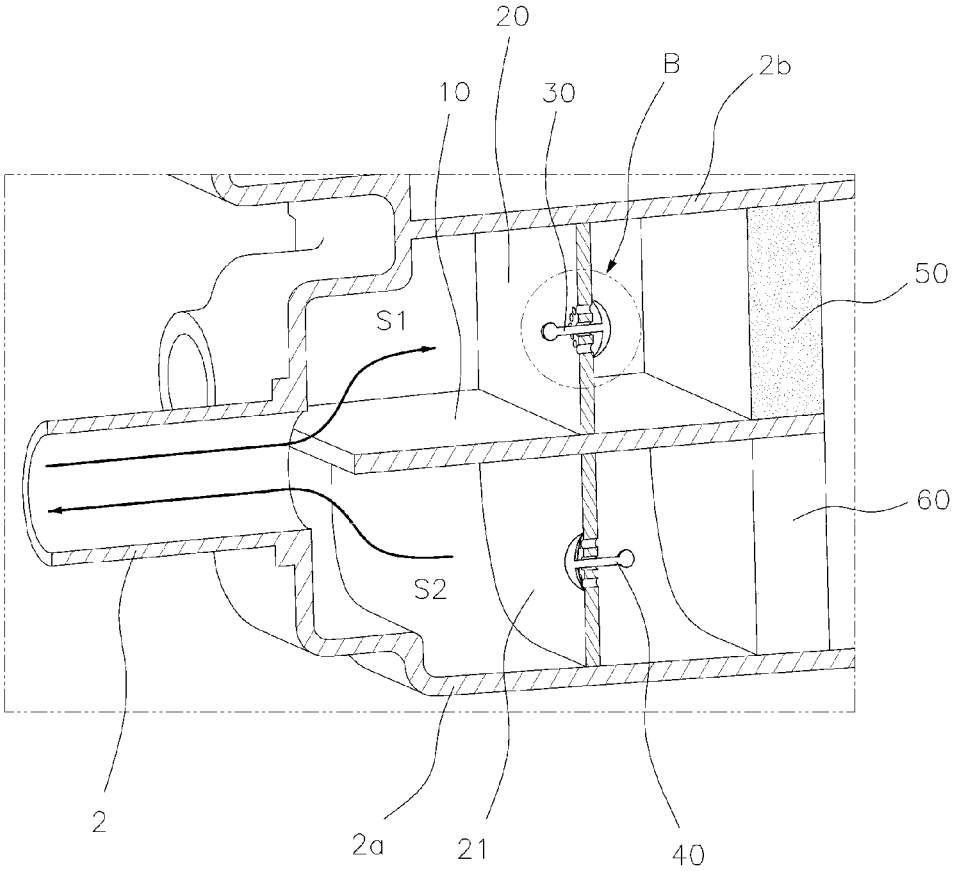
FIG. 3 is a configuration diagram of an exemplary air entrance of a canister according to the present invention.

FIG. 3 is a configuration diagram of an air entrance of a canister according to various embodiments of the present invention.

The canister according to various embodiments of the present invention is configured to divide an inner space of an air entrance 2 of the canister into two spaces and allow air to flow in from an outdoor atmosphere through one space of two spaces in a purging operation and discharge fuel evaporation gas to the outdoor atmosphere through the other space when the fuel evaporation gas is discharged in order to prevent pressure in a fuel tank from being raised, in order to prevent clogging of a filter from occurring in a known canister.

Hereinafter, the configuration of the canister according to various embodiments of the present invention will be described in more detail with reference to the accompanying drawings. An inner space of the canister from the air entrance 2 to a part where the filter is installed is referred to as an 'inner space of the air entrance' in the specification of the present invention for convenience.

The canister according to various embodiments of the present invention includes a central partition 10 that is installed in a direction parallel to the air entrance 2 in the inner space of the air entrance and partitions the inner space of the air entrance into an upper space S1 and a lower space S2.

Further, after-mentioned valves for opening and through air flow each space partitioned into the upper space S1 and the lower space S2 as described above are installed. In order to install the valves, the canister according to various embodiments of the present invention includes an upper partition 20 installed upward on the central partition 10 and a lower partition 21 installed downward on the central partition 10.

The upper partition 20 is extended from the central partition 10 up to an inner wall 2*b* of the air entrance and the lower partition 21 is extended from the central partition 10 up to an external wall 2*a* of the air entrance.

The upper partition 20 and the lower partition 21 may be installed perpendicularly to the central partition 10.

Further, an upper valve 30 that opens and closes the flow of air to the upper space S1 is installed on the upper partition 20.

In addition, a lower valve 40 that opens and closes the flow of air to the lower space S2 is installed on the lower partition 21.

The upper valve 30 and the lower valve 40 may be electronic control valves which can be controlled by an electric signal of an electronic control unit (ECU) of a vehicle.

The upper space S1 is partitioned into a front end from the air entrance 2 up to the upper partition 20 and a rear end from the upper partition 20 up to an upper filter 50 to be described below by the upper partition 20.

Further, the lower space S2 is partitioned into a front end from the air entrance 2 up to the lower partition 21 and a rear end from the lower partition 21 up to a lower filter 60 to be described below by the lower partition 21.

The upper filter 50 and the lower filter 60 are mounted on the rear ends of the upper partition 20 and the lower partition 21, respectively and the upper filter 50 interrupts impurities such as dust of the air that flows to the upper space S1 and the lower filter 60 interrupts impurities such as dust of the air that flows to the lower space S2.

In this case, the upper filter 50 has the sizes of pores to allow the air to smoothly flow by minimizing a ventilation resistance in the upper space S1 when the canister performs the purge operation.

Further, the lower filter 60 has the sizes of pores to disable the minute powders of the activated carbon to be discharged when the fuel evaporated gas of the canister is discharged to the outdoor atmosphere.

The sizes of the pores of the upper filter 50 may be larger than those of the pores of the lower filter 60. In various embodiments of the present invention, the sizes of the pores of the upper filter 50 are 80 μm and the sizes of the pores of the lower filter 60 are 10 μm. The lower filter 60 has the pores relatively denser than the upper filter 50.

Figure 4:
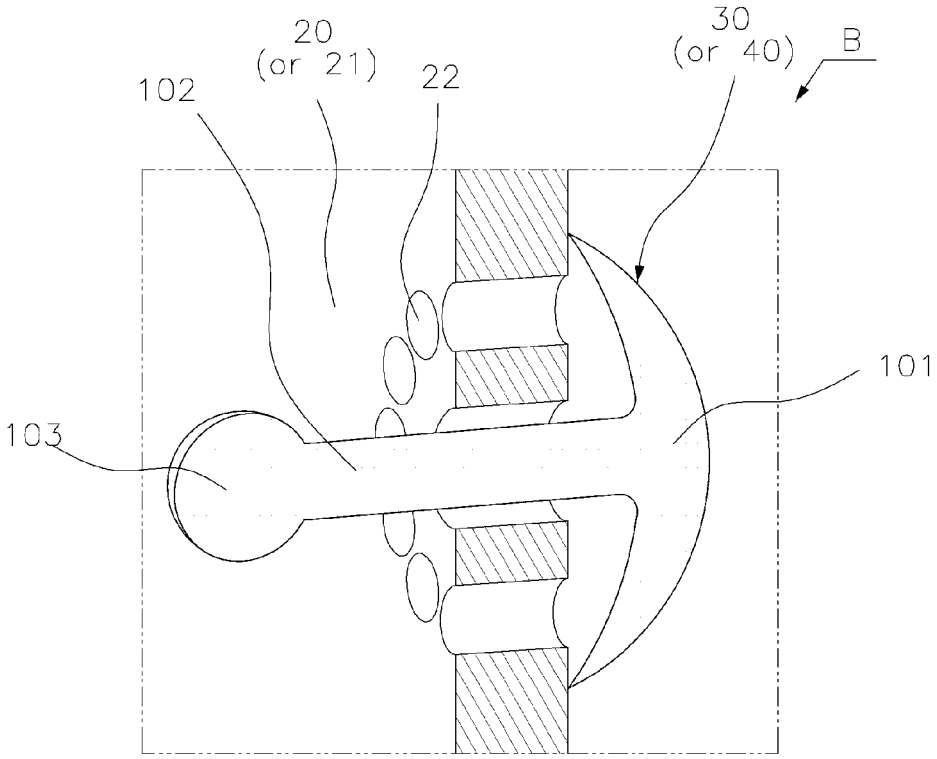
FIG. 4 is a detailed diagram of part B of FIG. 3.

FIG. 4 shows the upper valve 30 (alternatively, the lower valve 40) according to various embodiments of the present invention.

A plurality of ventilation holes 22 that allow the air to flow are formed on the upper partition 20 and the lower partition 21 of the canister according to various embodiments of the present invention and the ventilation holes 22 are opened and closed by operating the upper valve 30 and the lower valve 40.

The upper valve 30 and the lower valve 40 include a front disk 101 and a rear disk 103 opening and closing the ventilation holes 22 of the upper partition 20 or the lower partition 21 and a rod 102 coupling the front disk 101 and the rear disk 103 to each other. Any one of the front disk 101 and the rear disk 103 is opened and closed depending on forward and backward movements of the rod 102.

Figure 5:
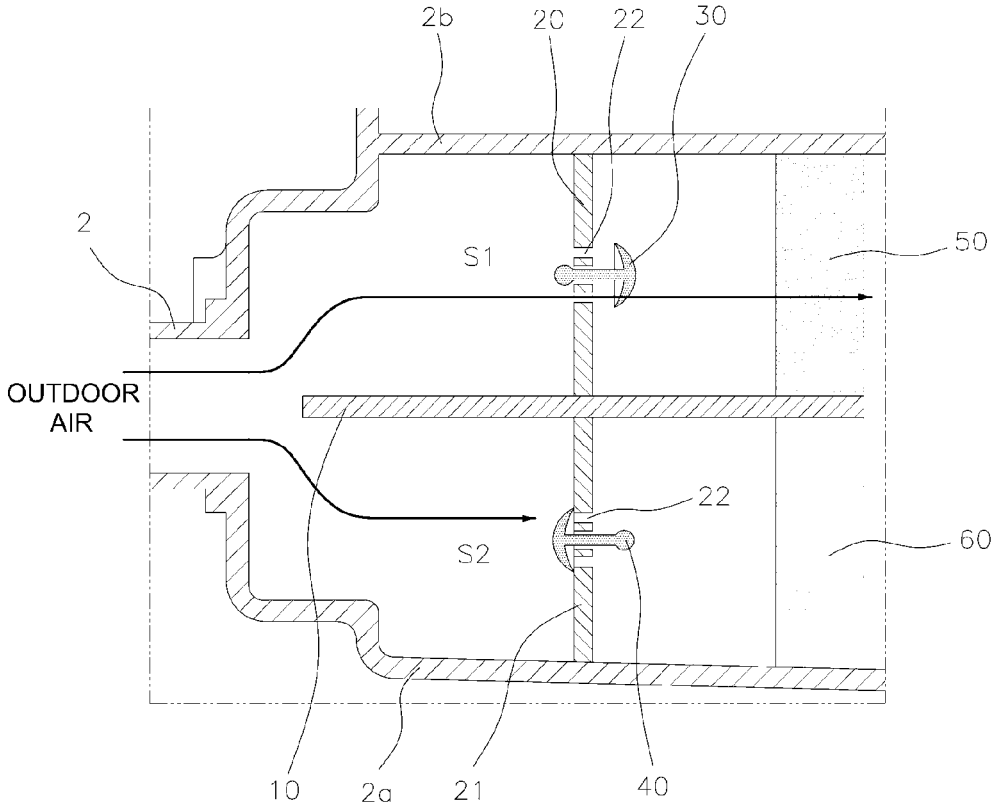
FIG. 5 is a diagram showing an operating state of the air entrance of an exemplary canister according to the present invention in a purge operation.

FIG. 5 is a diagram showing an operating state of the air entrance of the canister according to various embodiments of the present invention in a purge operation.

Air flowing into the air entrance 2 through an air filter of the vehicle flows to each of the upper space S1 and the lower space S2 partitioned by the central partition 10 in the purge operation.

In addition, the upper valve 30 is opened and the lower valve 40 is closed by the control of the electronic control unit of the canister according to various embodiments of the present invention.

Therefore, the air flowing into the upper space S1 passes through the upper partition 20 through the ventilation holes 22 of the upper valve 30 and enters an inner part of the canister through the upper filter 50 to flow toward the intake system of the engine, but the air flowing into the lower space S2 does not pass through the lower partition 21 because the lower valve 40 is closed, and as a result, the air cannot enter the inner part of the canister any longer.

In this case, the pore sizes of the upper filter 50 as the sizes to minimize the ventilation resistance in the upper space S1 when the canister performs the purge operation allow the air to flow very smoothly in the upper filter 50.

In various embodiments of the present invention, the pore sizes of the upper filter 50 are 80 μm, larger than 10 μm which is the pore size of a known filter, and as a result, the air flows very smoothly.

Figure 6:
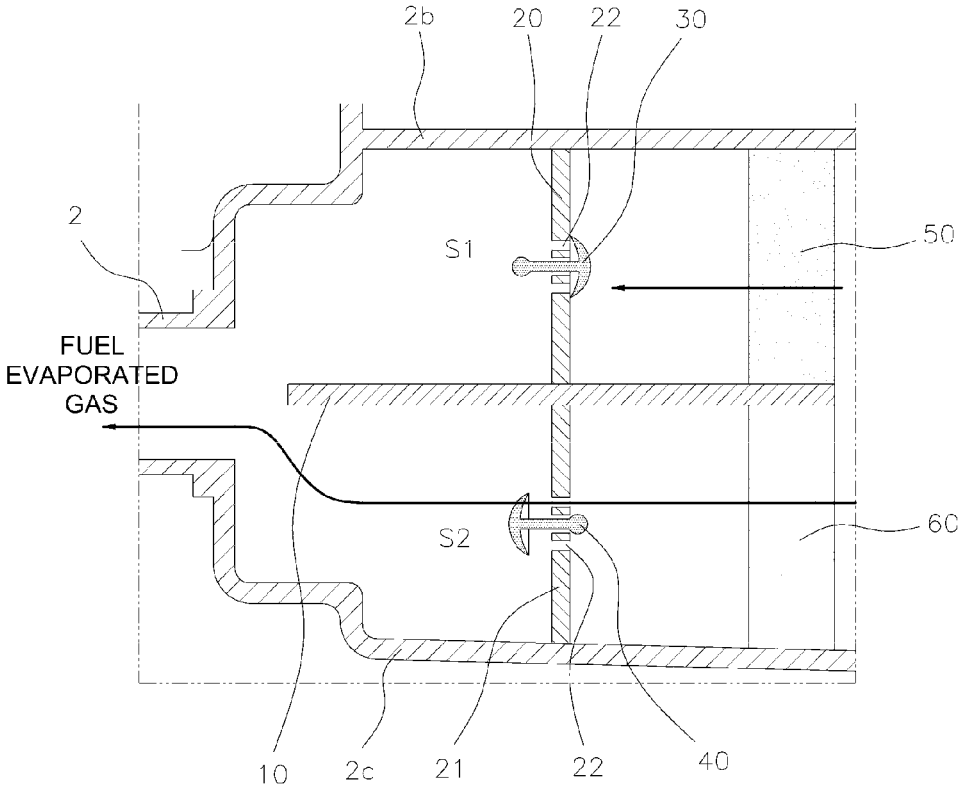
FIG. 6 is a diagram showing an operating state of the air entrance of an exemplary canister according to the present invention when fuel evaporated gas is discharged.

FIG. 6 is a diagram showing an operating state of the air entrance of the canister according to various embodiments of the present invention when fuel evaporated gas is discharged.

The fuel evaporated gas flowing from the fuel tank of the vehicle flows to each of the upper space S1 and the lower space S2 partitioned by the central partition 10 when the fuel evaporated gas is discharged.

In addition, the upper valve 30 is closed and the lower valve 40 is opened by the control of the electronic control unit of the canister according to various embodiments of the present invention.

Therefore, the fuel evaporated gas flowing into the lower space S2 passes through the lower partition 21 through the ventilation holes 22 of the lower valve 40 and is discharged to the outdoor atmosphere through the air entrance 2. In addition, negative pressure by the fuel evaporated gas in the fuel tank is prevented by discharging the fuel evaporated gas.

However, the fuel evaporated gas flowing into the upper space S1 cannot pass through the upper partition 20 because the upper valve 30 is closed, and as a result, the fuel evaporated gas cannot enter the air entrance 2 any longer.

In this case, since the pore sizes of the lower filter 60 are the size not to discharge the minute powders of the activated carbon through the air entrance 2, the minute powders of the activated carbon is interrupted by the lower filter 60 not to be discharged to the outside.

In various embodiments of the present invention, the pore sizes of the lower filter 50 employ the pore sizes of 10 μm similar to the sizes of the minute powders of the activated carbon.

By the operation of the canister according to various embodiments of the present invention, outdoor air entering the inner part of the canister from the air entrance 2 flows smoothly in the purge operation and the minute powders of the activated carbon are not discharged to the outside when the fuel evaporated gas is discharged.

For convenience in explanation and accurate definition in the appended claims, the terms upper or lower, front or rear, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A canister with dual air flow paths, used in a vehicle, the canister comprising:

a central partition installed in direction parallel to an air entrance in an inner space of the air entrance and partitioning the inner space of the air entrance into an upper space and a lower space;

an upper partition installed to extend upwards from the central partition up to an inner wall of the air entrance and a lower partition installed to extend downward from the central partition up to an outer wall of the air entrance;

an upper valve installed on the upper partition and opening and closing the flow of air to the upper space and a lower valve installed on the lower partition and opening and closing the flow of air to the lower space; and an upper filter mounted on a rear end of the upper partition and a lower filter mounted on a rear end of the lower partition, wherein the lower filter has the sizes of pores not to discharge minute powders of activated carbon included in the canister and the sizes of pores of the upper filter are larger than those of the pores of the lower filter.

2. The canister with dual air flow paths of claim 1, wherein a plurality of ventilation holes that allow air to flow are formed on the upper partition and the lower partition and the ventilation holes are opened and closed by the upper valve and the lower valve.

3. The canister with dual air flow paths of claim 1, wherein the upper partition and the lower partition are installed perpendicularly to the central partition.

4. The canister with dual air flow paths of claim 1, wherein the upper valve and the lower valve are electronic control valves controlled by an electronic control unit of the vehicle.

* * * * *